US009254551B2

(12) United States Patent
Kuhlman

(10) Patent No.: US 9,254,551 B2
(45) Date of Patent: Feb. 9, 2016

(54) SHOT BLAST CABINET AND TRACK SYSTEM

(71) Applicant: Maxi-Blast, Inc., South Bend, IN (US)

(72) Inventor: Frank W. Kuhlman, Osceola, IN (US)

(73) Assignee: Maxi-Blast, Inc., South Bend, IN (US)

( * ) Notice: Subject to any disclaimer, the term of this patent is extended or adjusted under 35 U.S.C. 154(b) by 0 days.

(21) Appl. No.: 14/479,744

(22) Filed: Sep. 8, 2014

(65) Prior Publication Data

US 2014/0378029 A1 Dec. 25, 2014

Related U.S. Application Data

(63) Continuation of application No. 13/493,303, filed on Jun. 11, 2012, now Pat. No. 8,827,770.

(60) Provisional application No. 61/520,545, filed on Jun. 10, 2011.

(51) Int. Cl.

| | |
|---|---|
| ***B24C 1/08*** | (2006.01) |
| ***B24C 3/06*** | (2006.01) |
| ***B24C 3/12*** | (2006.01) |
| ***B24C 3/18*** | (2006.01) |
| ***B24C 9/00*** | (2006.01) |
| ***B24C 1/00*** | (2006.01) |

(52) U.S. Cl.

CPC ... *B24C 9/00* (2013.01); *B24C 1/00* (2013.01); *B24C 3/06* (2013.01); *B24C 3/12* (2013.01); *B24C 3/18* (2013.01)

(58) Field of Classification Search

CPC ..... B24C 1/08; B24C 1/086; B24C 3/06; B24C 3/08; B24C 3/085; B24C 3/086; B24C 3/12; B24C 3/18

USPC ..... 451/38, 49, 80–84, 87, 89, 90

See application file for complete search history.

(56) References Cited

U.S. PATENT DOCUMENTS

| | | | | | |
|---|---|---|---|---|---|
| 4,300,318 | A * | 11/1981 | Brown | 451/88 |
| 4,928,440 | A * | 5/1990 | Hughes | 451/88 |
| 5,107,629 | A * | 4/1992 | Boyd et al. | 451/38 |
| 5,143,102 | A * | 9/1992 | Blaul | 134/58 R |
| 5,199,226 | A * | 4/1993 | Rose | 451/36 |
| 5,512,005 | A * | 4/1996 | Gulling | 451/29 |
| 8,371,903 | B2 * | 2/2013 | Goetsch et al. | 451/39 |
| 8,556,683 | B2 * | 10/2013 | Lynn et al. | 451/89 |
| 2002/0182988 | A1 * | 12/2002 | Williams et al. | 451/89 |
| 2006/0111022 | A1 * | 5/2006 | Sela et al. | 451/38 |
| 2012/0295517 | A1 * | 11/2012 | Swift et al. | 451/38 |
| 2013/0295822 | A1 * | 11/2013 | Robinson | 451/89 |

FOREIGN PATENT DOCUMENTS

DE 2109110 * 2/1973

* cited by examiner

*Primary Examiner* — Eileen Morgan

(74) *Attorney, Agent, or Firm* — Faegre Baker Daniels, LLP

(57) ABSTRACT

A blast cabinet, translation system, and process for use in blasting a surface of a part with abrasive particulate. The blast cabinet includes a basin for gathering abrasive particulate, a covering movable to enclose an opening over the basin, a frame supporting the basin, and a plurality of wheels for rolling movement of the cabinet. The system also includes a plurality of supports for holding the part to be blasted and a track system to guide movement of the cabinet. At least one of the wheels may be configured to mate with the track system, and the track system can be clamped to at least one part support.

19 Claims, 7 Drawing Sheets

SHOT BLAST CABINET AND TRACK SYSTEM

This is a continuation application of and claims priority from and the benefit of U.S. Nonprovisional patent application Ser. No. 13/493,303 filed on Jun. 11, 2012 and claims priority from and benefit of U.S. Provisional Patent Application Ser. No. 61/520,545 filed Jun. 10, 2011, the complete disclosures of which are hereby expressly incorporated by reference.

BACKGROUND OF THE INVENTION

This invention relates to a cabinet used to enclose or partially enclose a work piece in order to blast at least part of the surface with a particulate material, and in particular, the invention relates to a cabinet that is mounted on a track system to provide lateral movement of the cabinet for accessing different areas of the surface of the work piece.

It is well known that surfaces of parts may be treated by such techniques as blast cleaning, peening, abrading, etc. Such treatments are typically accomplished by projecting abrasive particulates, such as steel shot, grit, sand, plastics and the like, against the surface to be treated with necessary velocity and exposure time to accomplish the desired treatment effect. The abrasive particulates may be projected against the surface by means of air pressure blasting or by airless means, for example, such as a centrifugal blasting wheel.

It is also known that a cabinet may be provided in which to place the part to be blasted. Such a cabinet provides a controlled environment and containment for the blasting process. That is, the abrasive particulates that are used to blast the part can be contained within the blast cabinet for reuse and to minimize cleanup.

It is desirable to minimize the size of a blast cabinet for portability and space considerations; however, parts to be blasted may be longer than the blast cabinet. Accordingly, it is known to provide one or more openings in a blast cabinet with a seal arrangement, such as brushes through which an elongated part may have a surface to be cleaned contained within the cabinet, but a portion of the part extends through the openings. The seal members help maintain any blasting material that is projected towards the openings within the cabinet.

It can be cumbersome to move and readjust the part in the blast cabinet to blast another portion of the surface area of the part that was initially protruding out from an opening in the cabinet. Accordingly, it is an object of the invention to provide a mechanism and method for easily locating or relocating a portion of the part in the blast cabinet to be blasted. In particular, it is an object of the invention to provide a track system in which the blast cabinet can be readily translated along the length of the part to blast different surface areas of the part.

SUMMARY OF THE INVENTION

In one embodiment of the invention, a blast cabinet and translation system is provided for use in blasting a surface of a part with abrasive particulate. The blast cabinet includes a basin for gathering abrasive particulate, a covering movable to enclose an opening over the basin, a frame supporting the basin, and a plurality of wheels for rolling movement of the cabinet. The system also includes a plurality of supports for holding the part to be blasted and a track system to guide movement of the cabinet. At least one of the wheels may be configured to mate with the track system, and the track system can be clamped to at least one part support.

In one embodiment, the basin has a configuration of an inverted pyramid having an open top and closed bottom. The track system may include one or more track sections having an angular configuration including legs extending from an angled portion. The ends of the legs of the angular track sections form the base of the track and the angled portion forms a summit. The wheels may be configured to mate with the track system, and in one embodiment, have a concave V-shaped configuration along the outer circumference. The blast cabinet and translation system may include clamps for clamping the track system to at least one support. The clamp can include a flat portion mounted to a base of the support, and an angled portion extending from the flat portion and overlapping a portion of the track section. The blast cabinet and translation system may include two wheels having a concave V-shaped outer circumference and mounted to the frame with fixed casters, and two wheels having a cylindrical outer circumference and mounted to the frame with pivoting casters.

The covering may include side panels with openings therethrough and seal members mounted in the openings. The seal members may include brush-like bristles. The support system may include two fixed support members that have a flat base, telescoping portions and roller members mounted to the telescoping portions. The support system may further include an intermediate support having a base, rollers mounted to the base, a telescoping portion, and a roller member.

In another embodiment of the invention, a method for blasting a surface of a part with abrasive particulate is provided, including the steps of providing a blast cabinet having a covering with openings and seal members around the openings configured to allow the part to extend from within the cabinet to outside the cabinet, the cover being movable to enclose over a basin, a frame supporting the basin, and a plurality of wheels for rolling movement of the cabinet; providing a plurality of supports for holding the part to be blasted; providing a track system with at least one section of track to guide movement of the cabinet; providing a blasting apparatus mounted in the cabinet for projecting particulate onto the surface of the part; and moving the cabinet on the track system while the part stays stationary on the supports to facilitate blasting portions of the surface on the parts that were initially outside the cabinet.

The wheels may be configured to mate with the track system, and the track is clamped to at least one part support. The track may have an angular configuration that includes legs extending from an angle portion. The ends of the legs of the angular track sections form the base of the track and a corner portion forms a summit. Some of the wheels may be configured to ride along the angular track sections and may have a V configuration along the outer circumference. Two wheels may have a V-shaped outer circumference mounted to the frame with fixed casters, and two wheels may have a cylindrical outer surface and can be mounted to the frame with pivoting casters.

The method may also include the steps of blasting the part while the cabinet is moving along the track system, or stopping the blasting process, moving the cabinet along the track relative to the part, and re-initiating the blasting process, and/or repositioning the part on the supports or moving both the cabinet and the supports.

BRIEF DESCRIPTION OF THE DRAWINGS

The above-mentioned and other features and objects of this invention and the manner of obtaining them will become more apparent, and the invention itself will be better understood by reference to the following description of embodiments of the present invention taken in conjunction with the accompanying drawings, wherein.

Figure 1:
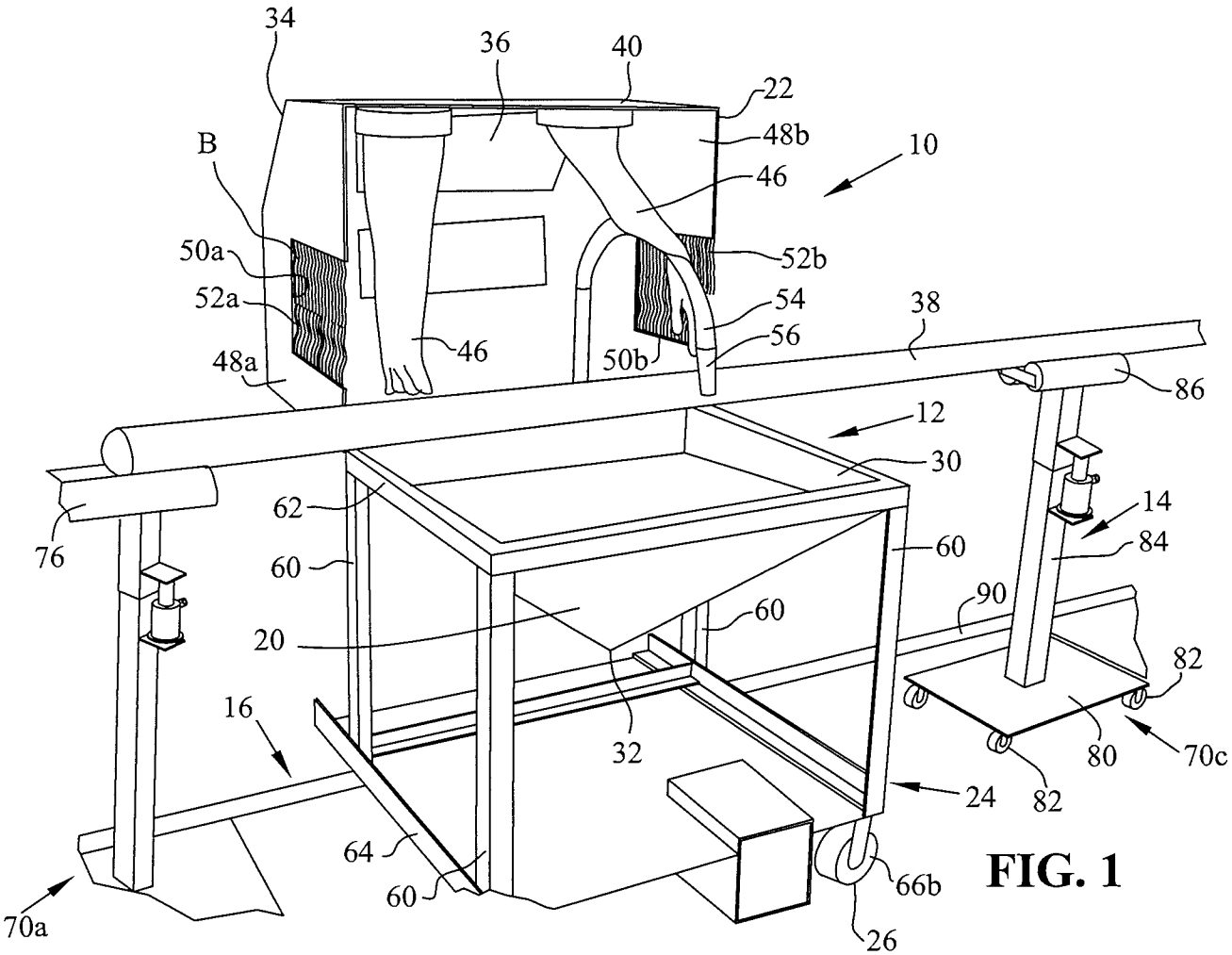
FIG. 1 is a perspective view of one embodiment of a blast cabinet in accordance with the subject invention with the cabinet door open and a part to be blasted set in place.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purpose of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Figure 2:
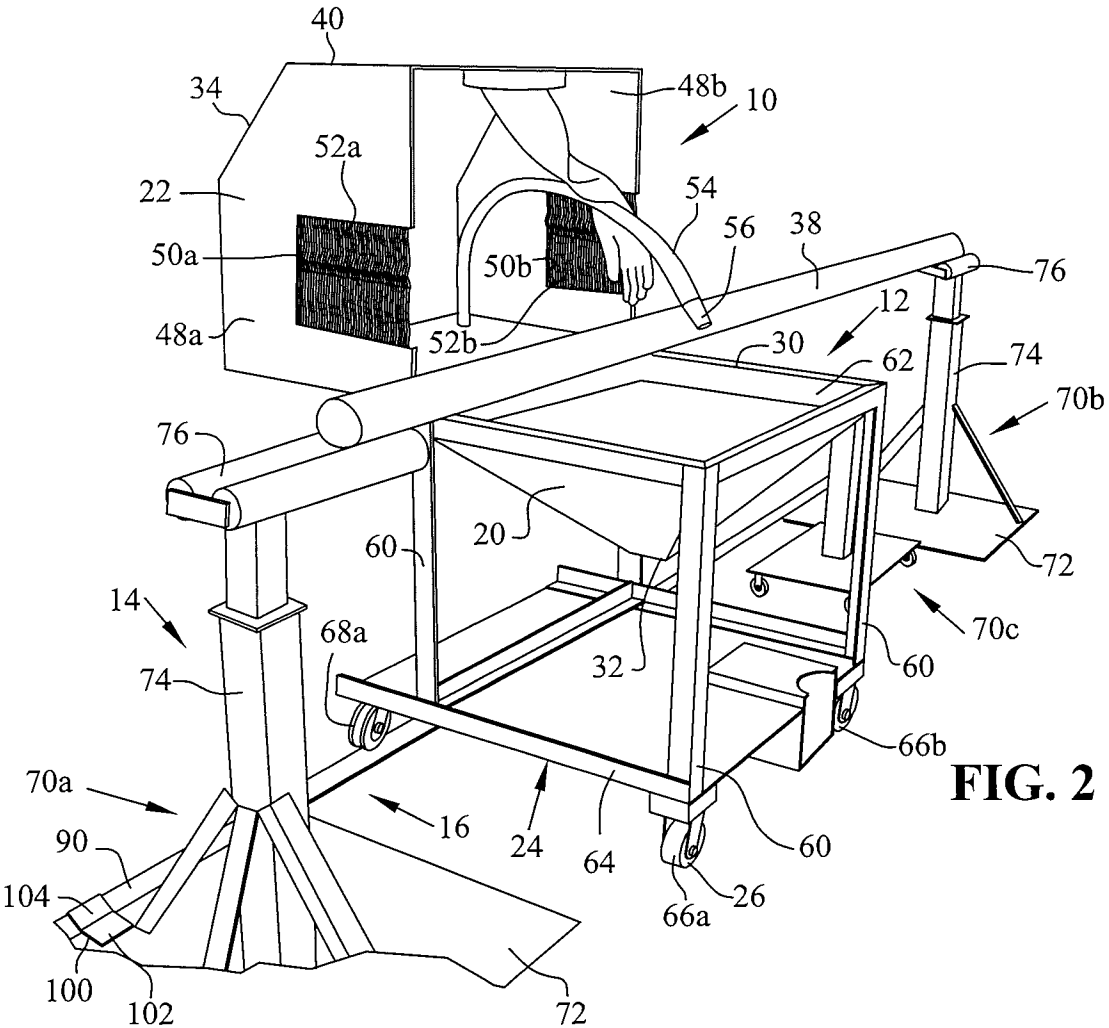
FIG. 2 is a side perspective view of the blast cabinet of FIG. 1 with the cabinet door open.
Figure 3:
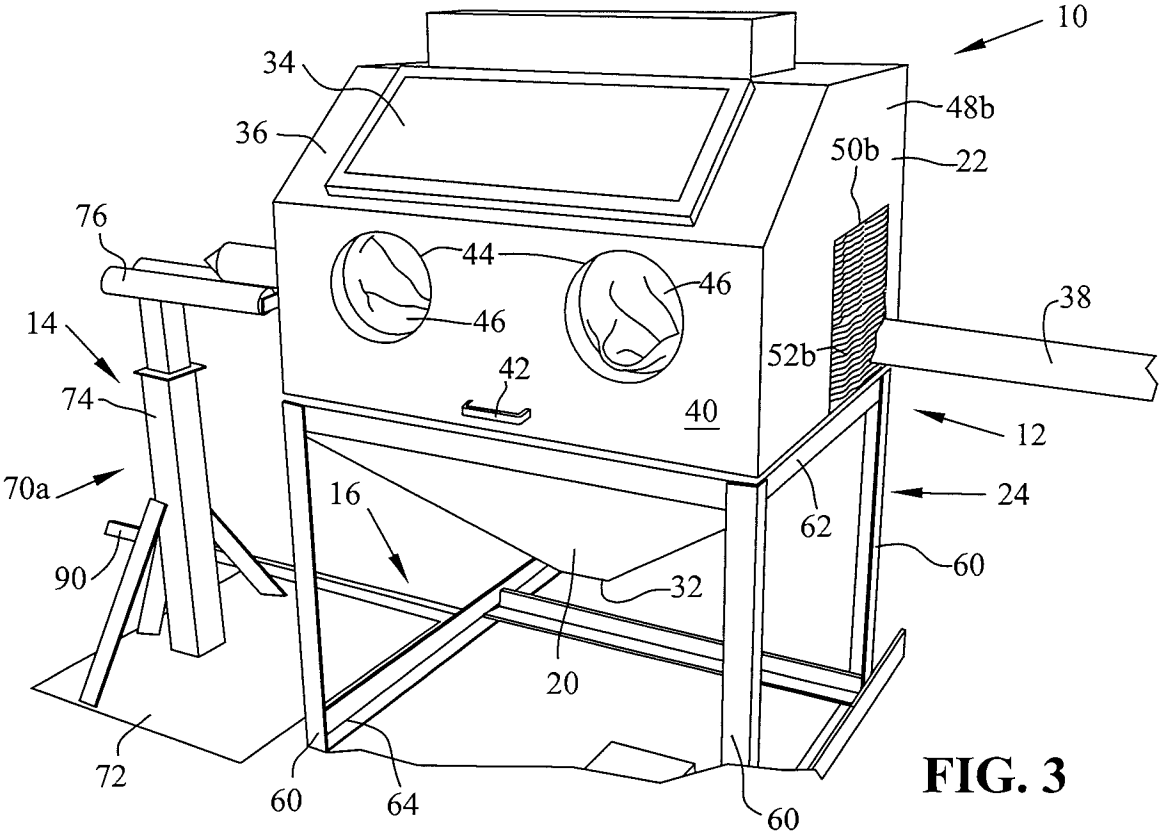
FIG. 3 is a perspective view of the blast cabinet of FIG. 1 with the cabinet door closed and the part extending through openings in the sides of the cabinet.
Figure 4:
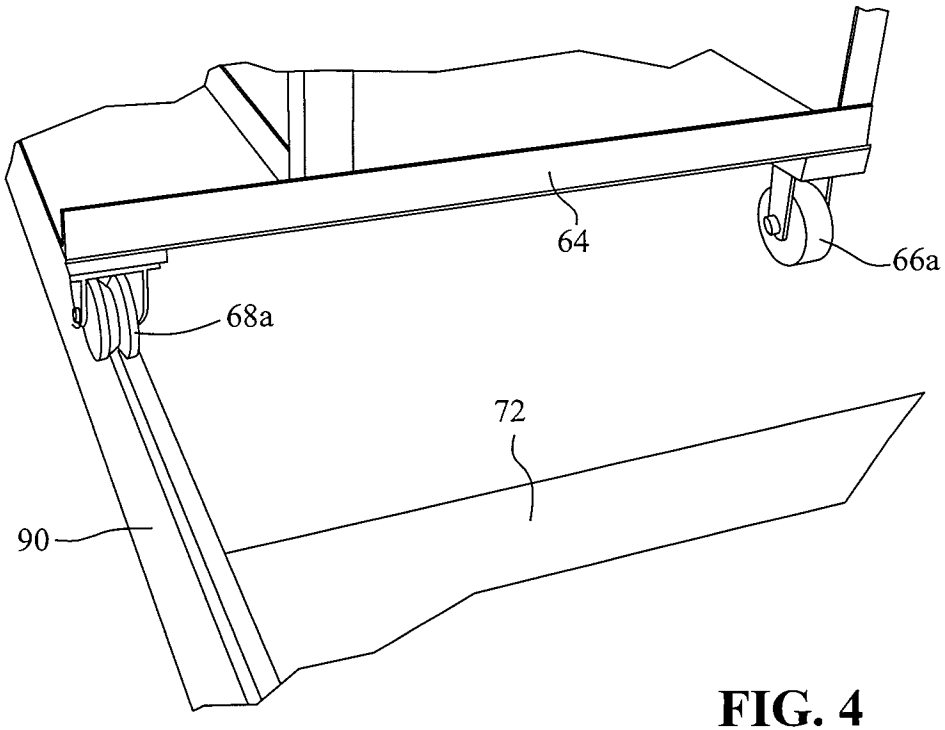
FIG. 4 is a side perspective view of the track and wheels of the blast cabinet.

Referring now to FIGS. 1-3, a blast system is shown, generally indicated as 10. Blast system 10 includes a cabinet, generally indicated as 12; a support system, generally indicated as 14; and a track system, generally indicated as 16. In the embodiment shown, cabinet 10 includes a basin 20, a door or covering 22, a frame, generally indicated as 24, and wheels or rolling members 26. In the embodiment shown, basin 20 has the general configuration of an inverted pyramid having an upper opening 30 and a bottom 32.

As is known and would be appreciated by one skilled in the art, the inverted pyramidal shape facilitates the collection of expended abrasive particulates to the bottom 32 of basin 20. The particulates can be vacuumed or scooped out from the bottom 32 of basin 20, or an opening (not shown) may be provided in bottom 32 and closed with a plug until it is desired to remove the particulates. Also, a hose or tube (not shown) may be connected to the opening to allow the particulates to be extracted by gravity or with a vacuum system (not shown).

In the embodiment shown, covering 22 has a generally rectangular configuration having dimensions suitable to enclose opening 30 of basin 20. The top front corner of door 22 has a diagonal planar member 34 instead of a squared configuration. Door 22 is attached to basin 20 and/or frame 24 with hinges or other known means (not shown) to provide a pivotal movement of door 22 relative to basin 20. The planar member includes a viewing window 36 so that an operator may view the blasting process of a part or work piece 38. Door 22 also includes a front panel 40 having a handle 42 and a pair of access openings 44 as best shown in FIG. 3. In the embodiment shown, a pair of gloves 46 are attached to respective access openings 44 as best shown in FIG. 1. Gloves 46 can be used to provide access for an operator to blast the portion of part 38 in cabinet 12 as is known.

Door 22 also includes a pair of side panels 48*a* and 48*b*. Side panels 48*a,b* include part openings 50*a*, 50*b*, respectively, from which part 38 may protrude from cabinet 12. Seal members 52*a* and 52*b* are placed within openings 50*a* and 50*b*, respectively, to seal around part 38 in order to prevent abrasive particulates from escaping cabinet 12 during the blasting process. In the embodiment shown, brush-like bristles are used for the seal members, but an elastomeric material or other known seals may be used. Referring to FIG. 2, blasting cabinet 12 also includes a tube 54 and nozzle 56 from which abrasive particulates are propelled to blast the surface of part 38.

Basin 20 of cabinet 12 is mounted to frame 24 for support. In the embodiment shown, frame 24 includes four vertical members 60, and a rectangular frame portion 62 mounted at the top of vertical members 60. Basin 20 is in turn mounted to rectangular frame portion 62 of frame 24. Attached to the bottom of vertical members 60 is a frame base portion 64. Cabinet 12 also includes wheels or rolling members 26 mounted to frame base portion 64. In the embodiment shown, cabinet 12 includes a pair of front wheels 66*a* and 66*b* mounted to frame base portion 64 with pivoting or rotating casters. Cabinet 12 also includes a pair of rear wheels 68*a* and 68*b*, which are mounted with fixed casters to frame portion 64. Also in the embodiment shown, front wheels 66*a* and 66*b* have a uniform cylindrical outer surface. On the other hand, rear wheels 68*a* and 68*b* include a V-shaped configuration on the outer surface thereof for mating with track system 16. Although four wheels are shown in the embodiment depicted, it should be appreciated that fewer or more wheels or rolling members may be used, and other caster and surface configurations of the wheels may be utilized.

Regarding support system 14 of blast system 10, the support system includes three support members generally indicated as 70*a*, 70*b*, and 70*c* in the embodiment shown. In the embodiment shown, support members 70*a* and 70*b* are the same and each includes a base 72, telescoping vertical supports 74, and roller supports 76 mounted to telescoping vertical support 74. As discussed in further detail below, telescoping supports 74 allow part 38 to be set at the proper height to align with openings 50*a* and 50*b* of blast cabinet 12, while roller supports 76 allow the part to be rotated to access all surfaces around the circumference of part 38.

Figure 7:
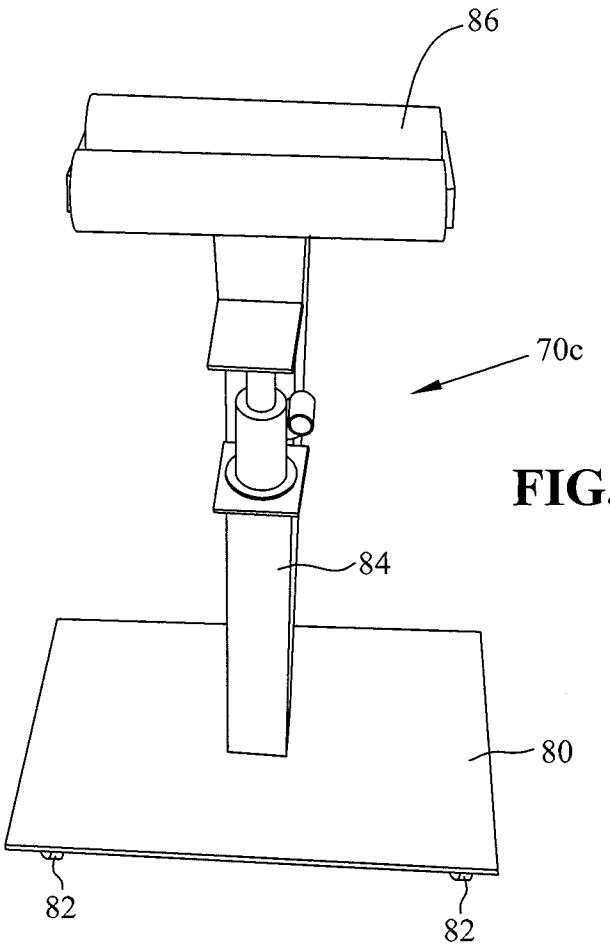
FIG. 7 is a front perspective view of a movable part supported on rollers.
Figure 8:
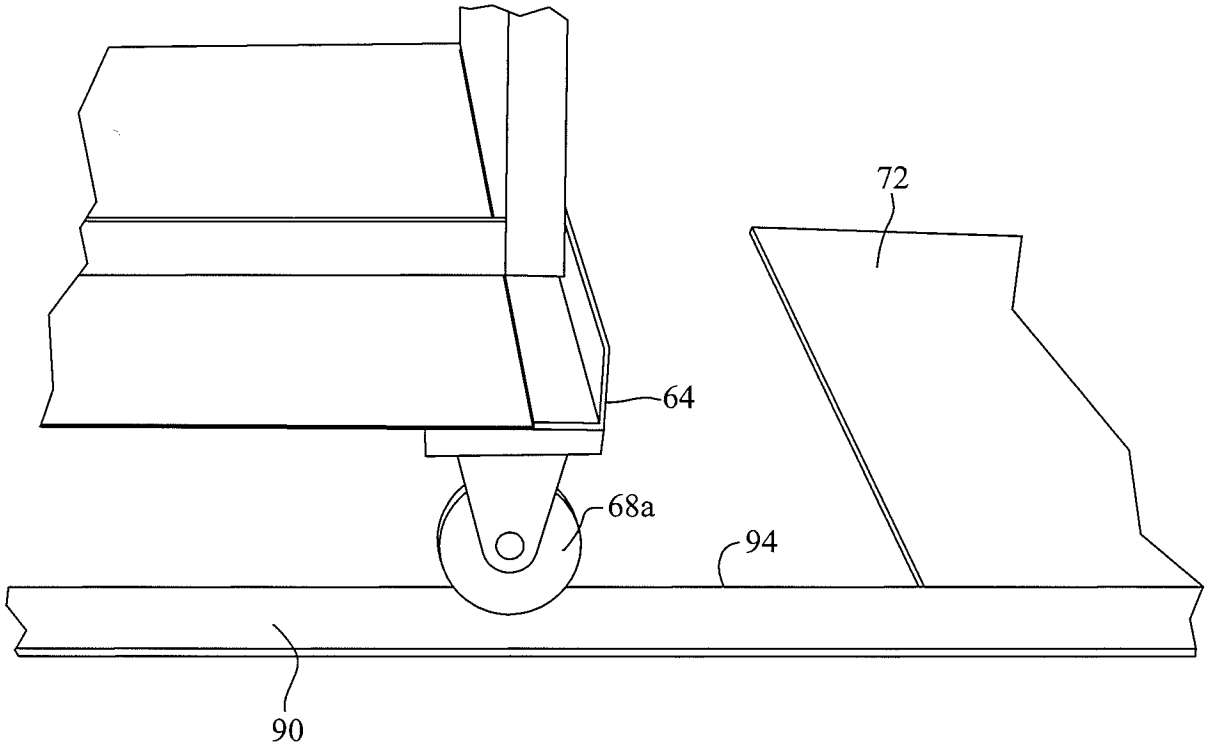
FIG. 8 is a rear perspective view of a lower portion of the cabinet and wheels on the track.

Support member 70*c* is a movable intermediate support and includes a base 80, rollers 82 for providing location adjustment, a telescoping member 84, and a roller support 86 as best shown in FIGS. 1 and 7. For long parts, intermediate roller support 70*c* can be set adjacent cabinet 12 for providing additional stability to part 38 or to blast the ends of part 38 as discussed below.

Figure 6:
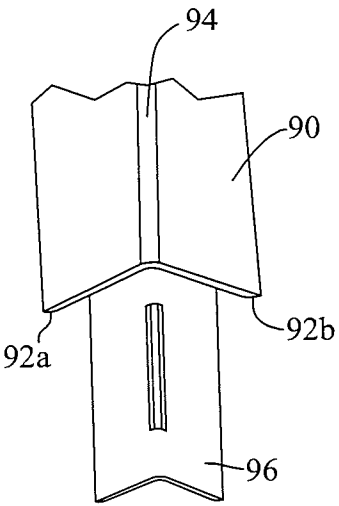
FIG. 6 is a plan view of the track and a connector for making extensions to the track.
Figure 9:
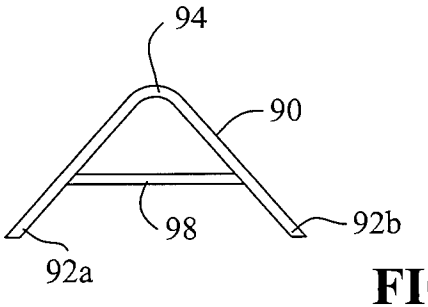
FIG. 9 is a side perspective view of a section of track and female connector to mate with the male connector of FIG. 6.

Now referring to track system 16, the track system includes one or more track sections 90, which are best shown in FIGS. 4-6 and 8-9. In the embodiment shown, track section 90 is manufactured from an angle member, and includes legs 92*a* and 92*b* (see FIGS. 6 and 9) and an angled portion 94. Legs 92*a* and 92*b* of the angle member form the base or support for the track. The back of the angle portion 94 is situated as the upward summit of the track sections 90 forming a triangular configuration. On one end of each track section 90 is located a male connector 96 (FIG. 6), which has an angular configuration like track sections 90 or solid triangular configuration, and is mounted underneath track sections 90 in the same orientation. As best shown in FIG. 6, male connectors 96 extend beyond the end of track section 90 for mating with a female connector 98 (FIG. 9). Female connector 98 is a straight member mounted horizontally and extending between legs 92*a,b* as shown in FIG. 9. Female connectors 98 are located on the opposite end of each track section 90 from male connector 96 so that male connectors 96 may be inserted between the adjacent track section 90 beneath the angled portion and above female connector 98 to provide a secure but readily removable connection between track sections. Connectors 96 and 98 may be attached to track sections 90 by welding or other known suitable means of attachment.

Figure 5:
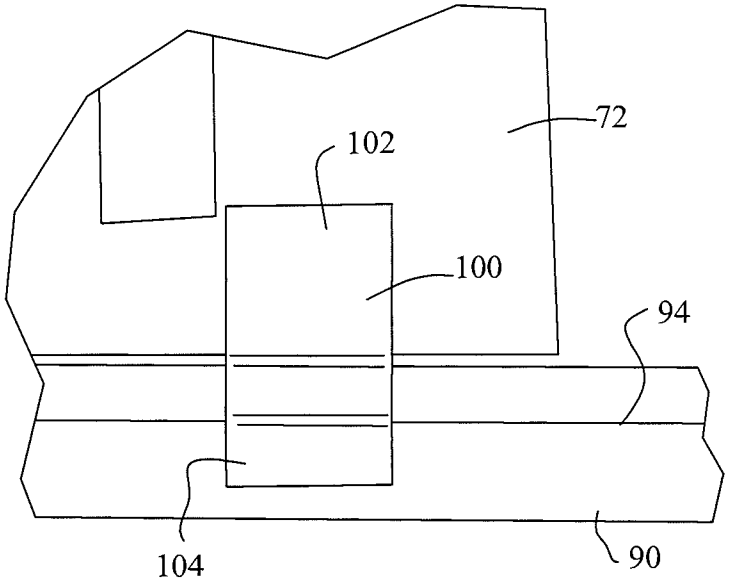
FIG. 5 is a plan view of the track and a clamp holding the track.

Track system 16 also includes at least one clamp 100 as best shown in FIG. 5. Clamps 100 are mounted to bases 72 of support members 70*a* and/or 70*b* for providing alignment of track sections 90 with the support members 70*a-c* and cabinet 12. In the embodiment shown, clamp 100 includes a flat portion 102 attached to base 72 by welding or other known means, and an angled portion 104 configured to mate with and hold the angled configuration of track sections 90 as shown in FIGS. 2 and 5. Note that angled portion 104 merely extends over the top of track sections 90 to hold them in place, but is not otherwise attached or affixed thereto. Of course, it should be appreciated that an adjustable screw or similar mechanism may be inserted through a threaded hole in angled portion 104 to more firmly engage track sections 90.

To assemble blast system 10 for use, supports 70*a* and 70*b* are set apart and distanced to support the ends of a part 38 to be placed thereon. Rollers 76 are aligned with one another so that a part placed thereon may be readily rotated and telescoping supports 74 are adjusted to the proper height to allow part 38 to extend through openings 50*a,b* of cabinet 12. Also, a suitable number of track sections are placed together using connectors 96 and 98, and the track sections are placed beneath clamps 100 mounted to base 72 of support members 70*a* and/or 70*b*. A cabinet 12 is put in place with the V grooves of rear wheels 68*a* and 68*b* aligned on the track sections 90. This will allow lateral (side-to-side) movement of the cabinet and alignment with track sections 90 and support members 70*a* and 70*b*. An intermediate support member 70*c* may be placed between support members 70*a* and 70*b* if required because of the length or span of the part to be blasted or to blast the ends of the part. Rollers 82 readily allow support member 70*c* to be located where desired with roller supports 86 aligned with roller supports 76 of support members 70*a* and 70*b*.

To use blast system 10, a part or work piece 38 is placed on the roller supports as shown in FIGS. 1-3, preferably with door 22 of cabinet 12 in the open position as shown in FIGS. 1 and 2. It should be appreciated that with the rear wheels 68*a* and 68*b* of cabinet 12 on track section 90, roller supports 76 will also be aligned with part openings 50*a*, 50*b* in door 22, when the door is in a closed position covering opening 30 of basin 20. Accordingly, with the work piece or part 38 in place on support members, door 22 can be closed so that part 38 will extend through cabinet 12 and out part openings 50*a* and 50*b* as shown in FIG. 3.

The portion of part 38 contained within cabinet 12 can then be blasted using tube 54 and nozzle 56 to blast abrasive particulates (not shown) onto the surface of part 38. The part can readily be rotated on rollers 76 and 86 to facilitate blasting of all surfaces within the cabinet. It should be appreciated that the cabinet and seal members 52*a* and 52*b* will contain a majority of blast particulates, which gravity will pull towards bottom 32 of basin 20. The particulates can be removed as discussed above.

To blast other surface areas of part 38, blast cabinet 12 can simply be rolled to the left or right as guided by rear wheels 68*a* and 68*b* traveling on track section 90. When the cabinet is in place, the next surface area portion of part 38 can be blasted. This procedure can be used until all surface area portions of part 38 desired to be blasted have been so taken care of. It should also be appreciated that the ends of part 38 may be removed from one or the other of support members 70*a* or 70*b* to blast the respective ends. At such times, part 38 can be balanced on the other support member 70*a* or 70*b* and movable intermediate support member 70*c*.

While the invention has been taught with specific reference to these embodiments, one skilled in the art will recognize that changes can be made in form and detail without departing from the spirit and scope of the invention. The described embodiments are to be considered, therefore, in all respects only as illustrative and not restrictive. As such, the scope of the invention is indicated by the following claims rather than by the description.

The invention claimed is:

1. A blast cabinet and translation system for use in blasting a surface of a part with abrasive particulate, comprising:

a basin for gathering abrasive particulate, a covering movable to enclose an opening over the basin, a frame supporting the basin, the covering includes side panels with openings there through configured to allow the part to extend from within the cabinet to the outside of the cabinet, and a plurality of wheels for rolling movement of the cabinet;

a plurality of supports for holding the part to be blasted, the supports being located entirely on an exterior of the cabinet and holding and rotating the part extending from within the blast cabinet to the exterior of the blast cabinet; and a track system to guide movement of the cabinet, at least one of the wheels configured to mate with the track system.

2. The blast cabinet and translation system as set forth in claim 1, wherein the basin has a configuration of an inverted pyramid having an open top and closed bottom.

3. The blast cabinet and translation system as set forth in claim 1, wherein the track system includes one or more track sections, each track section having a pair of legs with each leg having opposing ends, the legs being joined at one end thereof and extending outward from one another at an angle, the other ends of the legs being free ends.

4. The blast cabinet and translation system as set forth in claim 3, wherein the track sections sit on the free ends of the legs and the joined ends of the legs form a summit.

5. The blast cabinet and translation system as set forth in claim 4, wherein the wheels configured to mate with the track system have a V configuration along the outer circumference.

6. The blast cabinet and translation system as set forth in claim 5, further including clamps for clamping the track system to at least one support, the clamp including a flat portion mounted to a base of the support, and an angled portion extending from the flat portion and overlapping a portion of the track section.

7. The blast cabinet and translation system as set forth in claim 6, including two wheels having a V-shaped outer circumference and mounted to the frame with fixed casters, and two wheels having a cylindrical outer circumference and mounted to the frame with pivoting casters.

8. The blast cabinet and translation system as set forth in claim 1, wherein seal members are mounted in the openings.

9. The blast cabinet and translation system as set forth in claim 8, wherein the seal members include brush-like bristles.

10. A blast cabinet and translation system for use in blasting a surface of a part with abrasive particulate, comprising:

a basin the covering includes side panels with openings there through configured to allow the part to extend from within the cabinet to the outside of the cabinet, for gathering abrasive particulate, a covering movable to enclose an opening over the basin, a frame supporting the basin, and a plurality of wheels for rolling movement of the cabinet:

a plurality of supports for holding the part to be blasted, the supports being located entirely on an exterior of the cabinet and holding and rotating the part extending from within the blast cabinet to the exterior of the blast cabinet;

a track system to guide movement of the cabinet, at least one of the wheels configured to mate with the track system; and wherein the supports include two fixed support members having a flat base, telescoping portions and roller members mounted to the telescoping portions and wherein the supports further include an intermediate support member having a base, rollers mounted to the base, a telescoping portion, and a roller member.

11. A method for blasting a surface of a part with abrasive particulate, including the steps of:

providing a blast cabinet having a covering with openings and seal members around the openings configured to allow the part to extend from within the cabinet to outside the cabinet, the cover being movable to enclose over a basin, a frame supporting the basin, and a plurality of wheels for rolling movement of the cabinet;

providing a plurality of supports located entirely on an exterior of the blast cabinet for holding and rotating the part while being blasted such that there are no supports within the cabinet holding the part during blasting thereof;

providing a track system with at least one section of track to guide movement of the cabinet;

providing a blasting apparatus mounted in the cabinet for projecting particulate onto the surface of the part; and moving the cabinet on the track system while the part stays stationary on the supports to facilitate blasting portions of the surface on the parts that were initially outside the cabinet, while at least a portion of the part that was inside the cabinet is moved outside the cabinet.

12. The method for blasting a surface of a part with abrasive particulate as set forth in claim 11, wherein the wheels are configured to mate with the track system, and the track is clamped to at least one of the supports that hold the part for blasting.

13. The method for blasting a surface of a part with abrasive particulate as set forth in claim 12, wherein the track system includes one or more track sections, each track section having a pair of legs with each leg having opposing ends, the legs being joined at one end thereof and extending outward from one another at an angle, the other ends of the legs being free ends.

14. The method for blasting a surface of a part with abrasive particulate as set forth in claim 13, wherein the track sections sit on the free ends of the legs and the joined ends of the legs form a summit.

15. The method for blasting a surface of a part with abrasive particulate as set forth in claim 14, wherein some of the wheels are configured to ride along the angular track sections and have a V configuration along the outer circumference.

16. The method for blasting a surface of a part with abrasive particulate as set forth in claim 15, wherein two wheels have a V-shaped outer circumference and are mounted to the frame with fixed casters, and two wheels have a cylindrical outer surface and are mounted to the frame with pivoting casters.

17. The method for blasting a surface of a part with abrasive particulate as set forth in claim 11, including the step of blasting the part while the cabinet is moving along the track system.

18. The method for blasting a surface of a part with abrasive particulate as set forth in claim 11, including the steps of stopping the blasting process, moving the cabinet along the track relative to the part, and re-initiating the blasting process.

19. The method for blasting a surface of a part with abrasive particulate as set forth in claim 11, including the step of repositioning the part on the supports or moving both the cabinet and the supports.

* * * * *